US006354273B1

(12) United States Patent
Imura et al.

(10) Patent No.: US 6,354,273 B1
(45) Date of Patent: Mar. 12, 2002

(54) FUEL DELIVERY RAIL ASSEMBLY

(75) Inventors: Izumi Imura, Shizuoka; Yoshiyuki Serizawa, Susono; Kazuteru Mizuno, Shizuoka; Yasushi Sakamoto, Shizuoka; Hideo Ryu, Shizuoka; Teruhisa Takahashi, Mishima; Kazunori Takikawa, Numazu, all of (JP)

(73) Assignee: Usui Kokusai Sangyo Kaisha Ltd., Shizuoka (JP)

( * ) Notice: Subject to any disclaimer, the term of this patent is extended or adjusted under 35 U.S.C. 154(b) by 0 days.

(21) Appl. No.: 09/506,099

(22) Filed: Feb. 17, 2000

(30) Foreign Application Priority Data

Feb. 18, 1999 (JP) ..... 11-040654
Mar. 2, 1999 (JP) ..... 11-053725
Mar. 17, 1999 (JP) ..... 11-071178

(51) Int. Cl.[7] ..... F02M 41/00
(52) U.S. Cl. ..... 123/467; 123/456
(58) Field of Search ..... 123/467, 456, 123/447, 468, 469

(56) References Cited

U.S. PATENT DOCUMENTS 4,649,884 A 3/1987 Tuckey
4,660,524 A 4/1987 Bertsch et al.
4,729,360 A * 3/1988 Fehrenbach et al. ..... 123/447
4,732,176 A * 3/1988 Sugimura ..... 138/30
5,056,489 A * 10/1991 Lorraine ..... 123/468
5,476,080 A * 12/1995 Brunnhofer ..... 123/468
6,189,510 B1 * 2/2001 Jaeger ..... 123/468

FOREIGN PATENT DOCUMENTS

JP 60-240867 11/1985
JP 3-62904 9/1991
JP 11-2164 1/1999

* cited by examiner

*Primary Examiner*—Carl S. Miller
(74) *Attorney, Agent, or Firm*—Wenderoth, Lind & Ponack, L.L.P.

(57) ABSTRACT

A fuel delivery rail assembly for supplying fuel to a plurality of fuel injectors in an engine is provided. The assembly comprises an elongate conduit having a longitudinal fuel passage therein, a fuel inlet pipe, and a plurality of sockets. Outer walls of the conduit include at least one flat or arcuate flexible first absorbing surface, which is smoothly and integrally connected to an arcuate second absorbing surface. The first absorbing surface or the second absorbing surface faces fuel inlet ports of the sockets. The sectional configuration of the conduit can be flat, a telephone receiver shape, a character "T" shape, a corrugation shape, a dumbbell shape or a reverse eye mask shape. Thus, fuel pressure pulsations and shock waves are reduced by abrupt enlargements of fuel passages and bendings of the absorbing surfaces.

5 Claims, 5 Drawing Sheets

FUEL DELIVERY RAIL ASSEMBLY

BACKGROUND OF THE INVENTION

This invention relates to a fuel delivery rail assembly for an internal combustion engine, especially for an automotive engine, equipped with an electronic fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine. In particular, this invention relates to sectional constructions of a fuel conduit (fuel rail) having a fuel passage therein and connecting constructions between the conduit and sockets for receiving fuel injectors.

Fuel delivery rails are popularly used for electronic fuel injection systems of gasoline engines. There are two types of fuel delivery rails; one is a return type having a return pipe and another is a returnless (non-return) type. In the return type, fuel is delivered from a conduit having a fuel passage therein to fuel injectors via cylindrical sockets and then residual fuel goes back to a fuel tank via the return pipe. Recently, for economical reasons, use of the returnless type is increasing and new problems are arising therefrom. That is, due to pressure pulsations and shock waves which are caused by reciprocal movements of a fuel pump (plunger pump) and injector spools, the fuel delivery rail and its attachments are vibrated thereby emitting uncomfortable noise.

Japanese unexamined patent publication No. Hei 11-2164 entitled "a fuel delivery" refers to this problem and discloses a method of manufacturing the fuel delivery body by a steel press process for lowering the co-vibrating rotation caused by the pressure pulsation below the idling rotation and thereby limiting the rigidity and contents of the delivery body within a preselected range. However, in view of the fact that delivery bodies are ordinarily formed by a steel pipe having a circular section or rectangular section, it is rather difficult to adopt the method from the view points of specifications, strength or cost of the engine.

Japanese examined patent publication No. Hei 3-62904 entitled "a fuel rail for an internal combustion engine" refers to an injector lapping noise and discloses a construction of diaphragm which divides an interior of the conduit into a socket side and a tube side thereby absorbing pressure pulsations and injector residual actions by its flexibility. However, in order to arrange the flexible diaphragm within the longitudinal direction of the conduit, seal members and complex constructions become necessary, so that overall configurations are relatively restricted. As the results, there are defects that it cannot be applied to miscellaneous specifications of many types of engines.

Japanese unexamined patent publication No. Sho 60-240867 entitled "a fuel supply conduit for a fuel injector of an internal combustion engine" discloses a construction that at least one wall of a fuel supply conduit is comprised of a flexible wall so as to dampen fuel pressure pulsations, and the flexible wall is fixed to a rigid wall. However, since the flexible wall is fixed to the rigid wall, its flexibility is not sufficient for obtaining preferable dampening results.

SUMMARY OF THE INVENTION

It is an object of the present invention to provide a fuel delivery rail assembly which can reduce the pressure fluctuations within the fuel passages caused by fuel injections, and also to reduce the vibrations caused by fuel reflecting waves (shock waves), to thereby eliminate emission of uncomfortable noise and miscellaneous defects.

A conventional type of fuel delivery rail assembly comprises an elongate conduit having a longitudinal fuel passage therein, a fuel inlet pipe fixed to an end or a side of the conduit, and a plurality of sockets vertically fixed to the conduit adapted to communicate with the fuel passage and so formed as to receive tips of fuel injectors at their open ends.

According to the characteristics of the invention, outer walls of the fuel conduit include at least one flat or arcuate (arched) flexible first absorbing surface. The first absorbing surface is smoothly and integrally connected to an arcuate second absorbing surface. The first absorbing surface or the second absorbing surface faces fuel inlet ports of sockets, which are adapted to receive tips of fuel injectors. Thus, fuel pressure pulsations and shock waves are reduced by abrupt enlargements (spatial expansions) of fuel passages and bendings of the absorbing surfaces.

Several embodiments of the invention are exemplified as follows:

(A) Each section of the conduit is formed in a flat configuration comprised of flat portions and arcuate portions.

(B) Each section of the conduit is formed in a telephone receiver configuration.

(C) Each section of the conduit is formed in a character "T" configuration.

(D) Each section of the conduit is formed in a corrugation.

(E) Each section of the conduit is formed in a dumbbell configuration.

(F) Each section of the conduit is formed in a reverse eye mask configuration.

(G) The second absorbing surface is an arcuate flexible end cap fixed to a longitudinal end of the conduit.

As the results of the above constructions of the invention, in a fuel delivery rail assembly having a fuel conduit made by steel, stainless steel or press materials, it has been found that it becomes possible to eliminate the emission of uncomfortable noise due to the vibration and pressure pulsations which are caused by the reflecting waves of injections and lack of dampening performance of the conduit.

In a theoretical principle, when shock waves produced by the fuel injections flow into the fuel inlet of the sockets or flow away therefrom by momentary back streams, flexible absorbing surfaces absorb the shock and pressure pulsations. In addition, when thin plates having small spring constant are deflected and deformed, the space of contents varies, namely expands or shrinks, thereby absorbing pressure fluctuations.

In a preferred embodiment, an inner end of the fuel inlet pipe terminates and opens near the center of the longitudinal conduit. This position is adapted to obtain maximum deflections of the conduit, whereby deflections of the absorbing surfaces are increased so as to enhance shock absorbing performance. However, the position is preferably offset from the center of the socket in order to avoid direct transmission of fuel pressure pulsations.

In this invention, thickness of each wall of the conduit, ratio of the horizontal size to the vertical size, and the range of clearance between the fuel inlet of the socket and its confronting surface are preferably defined by experiments or calculations such that, especially during idling of the engine, the vibrations and pressure pulsations are minimized.

Since the present invention is directed essentially to the sectional construction of the conduit and connecting construction of the conduit and the sockets, interchangeability with the prior fuel delivery rails are maintained as far as the mounting dimensions are kept constant.

Other features and advantages of the invention will become apparent from descriptions of the embodiments, when taken in conjunction with the drawings, in which, like reference numerals refer to like elements in the several views.

DESCRIPTION OF THE PREFERRED EMBODIMENT

Figure 1:
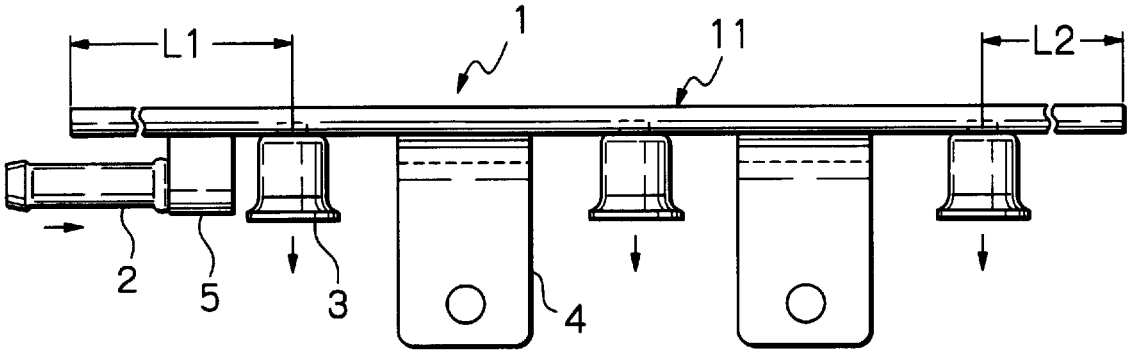
FIG. 1 is a frontal view of the fuel delivery rail assembly according to the invention.

Referring to FIG. 1, there is shown a preferable embodiment of the present invention, a fuel delivery rail assembly 1 of the so called "top feed type", adapted to three cylinders on one side of an automotive V-6 engine. The fuel conduit (rail) 11 comprised of flat steel pipes extends along a longitudinal direction of a crank shaft (not shown) of an engine. At the side of the conduit 11, a fuel inlet pipe 2 is fixed with an intermediate connector 5 by brazing or welding. Although at an end of the conduit 11 it is possible to provide a fuel return pipe for transferring residual fuel back to a fuel tank, the present invention is directed to non-return type having fuel pressure pulsation problems, so that the fuel return pipe is not provided.

At the bottom side of the conduit 11, three sockets 3 for receiving tips of fuel injectors are located corresponding to the number of cylinders at predetermined angles and distances from each other. To the conduit 11, two thick and rigid brackets 4 are fixed transversely so as to mount the assembly 1 onto the engine body. Fuel flows along the arrows thereby being discharged from the socket 3 and fuel injectors (not shown) into an air intake passage or cylinders of the engine.

Figure 2A:
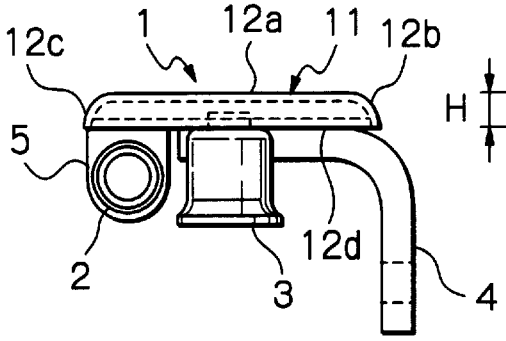
FIG. 2 is a side view of the assembly of FIG. 1 and vertical sectional view along the socket.
Figure 2B:
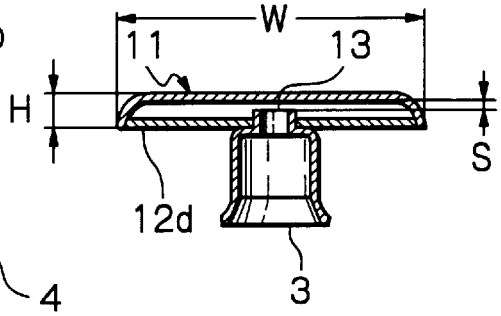

FIGS. 2A and 2B illustrate the side view of the assembly 1 of FIG. 1 and vertical section of the socket 3. Outer walls of the conduit 11 comprise a flat upper plate 12*a*, right and left arcuate side plates 12*b*, 12*c* which are smoothly and integrally connected to the upper plate 12*a*, and a flat bottom plate 12*d* which is brazed or welded to the side plates 12*b*, 12*c*. The lower surface of the flat plate 12*a* faces a fuel inlet port 13 of the socket 3. As the characteristics of the invention, the flat plate 12*a* provides a flexible first absorbing surface and the right and left arcuate side plates 12*b*, 12*c* provide flexible second absorbing surfaces.

The vertical and horizontal dimensions of the conduit 11 can be defined such that each wall thickness is 1.5 mm, the height H is 5 mm, and the width W is 46 mm. The spring constant of the flat construction 11 is about 40 kgf/cm square/mm. The clearance S between the fuel inlet port 13 and the lower surface of the flat plate 12*a* is less than 2 mm. As the results of continuous experiments, in which the dimensions are varied, it becomes apparent that the ratio of horizontal dimension relative to the vertical dimension is preferably 5 to 10, and that the clearance S is preferably between 0.5 to 3 mm. If the ratio is less than 5, the spring constant becomes larger and its flexibility is reduced, whereby absorbing performance of pressure pulsations becomes defective. If the ratio exceeds 10, a larger space becomes necessary for accommodating the fuel delivery rail assembly. If the clearance S is less than 0.5 mm, starting performance of the engine and accelerating performance become defective. If the clearance S is more than 3 mm, flexible performance becomes weak for deflecting the flat plate.

In addition, if the length L1, L2 from the center of the outer sockets 3 to each free end of the conduit 11 is larger than 30 mm, the deflections of the flat plates relative to the corresponding sockets 3 caused by the reflecting waves of the injection are smoothly enlarged thereby enhancing the shock absorbing performance.

According to the embodiment of FIGS. 1, 2A and 2B, when shock waves flow into the fuel inlet port 13 of the sockets or flow away therefrom by momentary back streams, the pressure pulsations are absorbed at the moment of release into the horizontal enlarged space. In addition, when thin absorbing surfaces 12*a*, 12*b*, 12*c* are deflected and deformed, the space of contents varies thereby absorbing pressure fluctuations.

Figure 3:
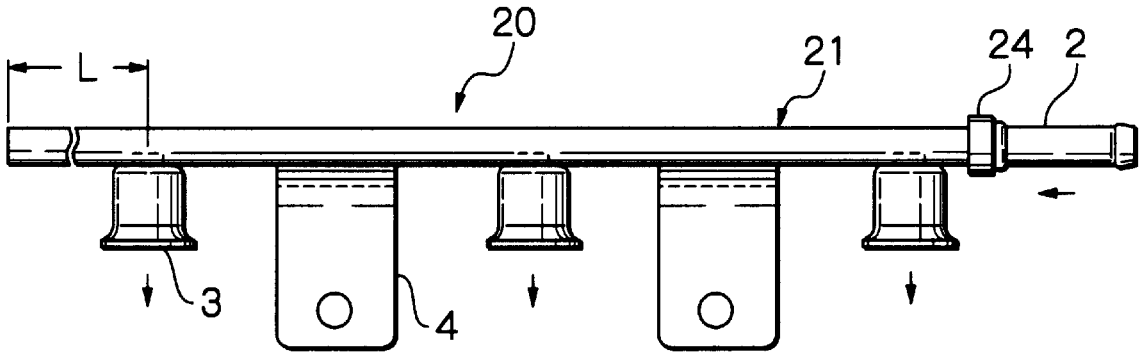
FIG. 3 is a frontal view of the fuel delivery rail according to another embodiment.
Figure 4A:
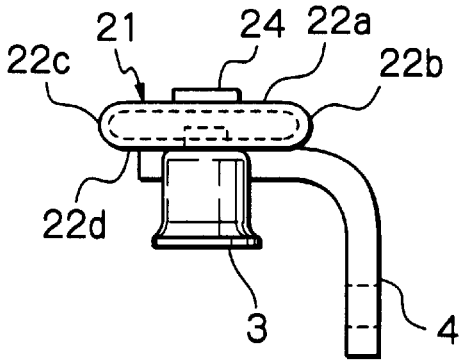
FIG. 4 is a side view of the assembly of FIG. 3 and vertical sectional view along the socket.
Figure 4B:
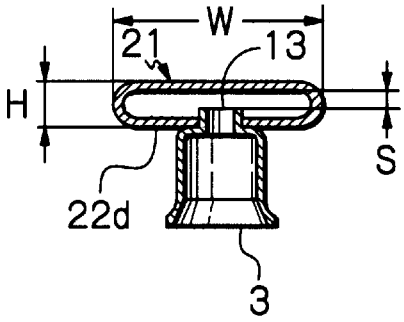

FIG. 3 illustrates a fuel delivery rail assembly 20 according to another embodiment of the invention. FIGS. 4A and 4B show a side view of the assembly 20 of FIG. 3 and vertical sectional view along the socket. A fuel conduit 21 is made in a flatly compressed arcuate section through the process in which a circular sectional stainless pipe is compressed vertically. The lower surface of an arcuate plate 22*a* faces the fuel inlet port 13 of the socket 3. At the end of the conduit 11, a fuel inlet pipe 2 is fixed with an intermediate connector 24 by brazing or welding.

As the characteristics of the invention, the flat portion 22*a* provides a flexible first absorbing surface and right and left arcuate side portions 22*b*, 22*c*, which are smoothly and integrally connected to the flat surface 22*a*, provide flexible second absorbing surfaces. Further, a bottom portion 22*d* also provides a flexible third absorbing surface. In this embodiment, the flat portion 22*a* faces the fuel inlet port 13 of the sockets 3.

The vertical and horizontal dimensions of the conduit 21 can be defined such that each wall thickness is 1.2 mm, the height H is 6.4 mm, and the width W is 32 mm. The spring constant of the flat construction 21 is about 65 kgf/cm square/mm. The clearance S between the fuel inlet port 13 and the lower surface of the flat plate 22*a* is less than 3 mm. As the results of continuous experiments, in which the dimensions are varied, it becomes apparent that the ratio of horizontal dimension relative to the vertical dimension is preferably 5 to 10, and that the clearance S is preferably between 0.5 to 3 mm.

In addition, if the length L from the center of the left socket 3 to the free end of the conduit 21 is larger than 30 mm, the deflections of the flat portions relative to the corresponding socket caused by the reflecting waves of the injection are smoothly enlarged thereby enhancing the shock absorbing performance.

According to the embodiment of FIGS. 3, 4A and 4B, when shock waves Flow into the fuel inlet port 13 of the sockets or flow away therefrom by momentary back streams, the pressure pulsations are absorbed at the moment of release into the horizontal enlarged space. In addition, when thin absorbing surfaces 22*a*, 22*b*, 22*c*, 22*d* are deflected and deformed, the space of contents would vary and thereby absorb pressure fluctuations.

Figure 5A:
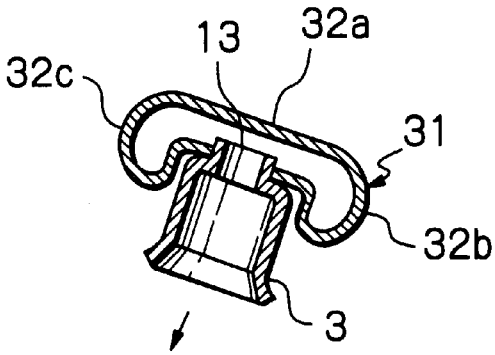
FIG. 5 is a vertical sectional view illustrating several embodiments of the connection between the socket and rail sections.

FIGS. 5A–D illustrate several embodiments of sectional constructions between the rail sections and the socket. FIG. 5A shows a third embodiment of the invention, in which the vertical section of a conduit 31 is formed in a telephone receiver configuration which includes a thin flat portion 32*a* and downwardly convex portions 32*b*, 32*c* connected to both sides of the flat portion 32*a*. The flat portion 32*a* provides a flexible first absorbing surface and the right and left downwardly convex portions 32*b*, 32*c*, which are smoothly and integrally connected to the flat portion 32*a*, provide flexible second absorbing surfaces. In this embodiment, the flat portion 32*a* faces the fuel inlet port 13 of the socket 3.

Figure 5B:
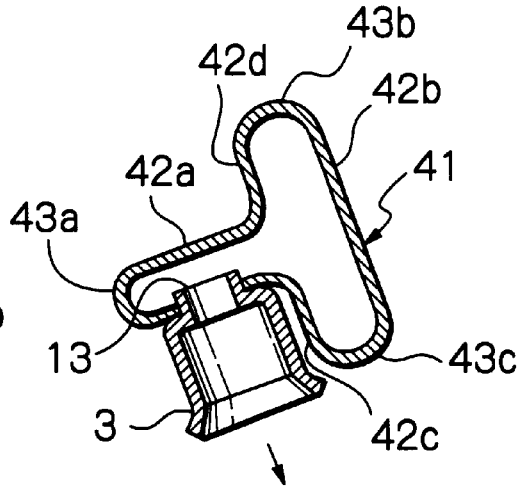

FIG. 5B shows a fourth embodiment of the invention, in which the section of a conduit 41 is formed in a character "T" which includes thin flat portions 42*a*, 42*b*, 42*c*, 42*d* and arcuate portions 43*a*, 43*b*, 43*c* connected to the sides of the flat portions. The flat portion 42*a* provides a flexible first absorbing surface and the arcuate portion 43*a*, which is smoothly and integrally connected to the flat portion 42*a*, provides a flexible second absorbing surface, and other portions also provide flexible third or further absorbing surfaces. In this embodiment, the flat portion 42*a* faces the fuel inlet port 13 of the socket 3.

Figure 5C:
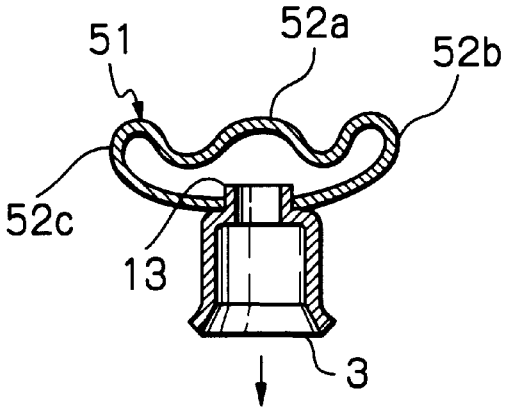

FIG. 5C shows a fifth embodiment of the invention, in which the section of the conduit 51 is roughly formed in a corrugation. That is, a thin convex arcuate portion 52*a* is formed in a corrugation, and is smoothly and integrally connected to right and left arcuate portions 52*b*, 52*c*. The arcuate portion 52*a* provides a flexible first absorbing surface and the arcuate portions 52*b*, 52*c* provide flexible second absorbing surfaces. The first absorbing surface 52*a* faces the fuel inlet port 13 of the socket 3.

Figure 5D:
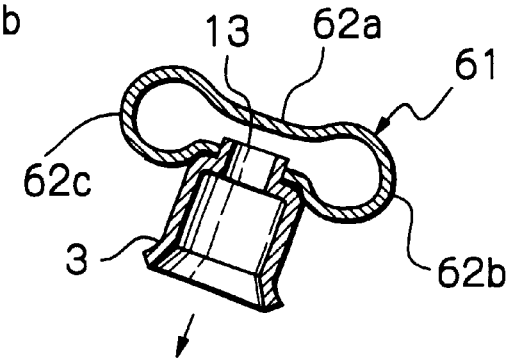

FIG. 5D shows a sixth embodiment of the invention, in which the section of a conduit 61 is formed in a dumbbell configuration. That is, a thin flat neck portion 62*a* of the conduit 61 is connected smoothly and integrally to a right and left semi-circular portions 62*b*, 62*c* thereby providing a dumbbell configuration. The flat portion 62*a* provides a flexible first absorbing surface and the semi-circular portions 62*b*, 62*c* provide flexible second absorbing surfaces. The first absorbing surface 62*a* faces the fuel inlet port 13 of the socket 3.

According to the embodiments of FIGS. 5A to 5D, when shock waves flow into the fuel inlet port 13 of the sockets or flow away therefrom by momentary back streams, the pressure pulsations are absorbed at the moment of release into the horizontal enlarged space. In addition, when thin absorbing surfaces 62*a*, 62*b*, 62*c* are deflected and deformed, the space of contents varies thereby absorbing pressure fluctuations.

Figure 6:
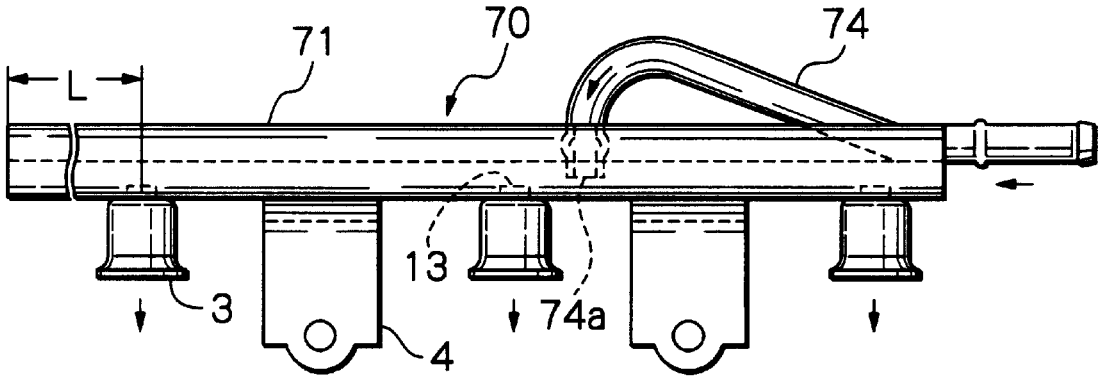
FIG. 6 is a frontal view of the fuel delivery rail assembly according to another embodiment.
Figure 7:
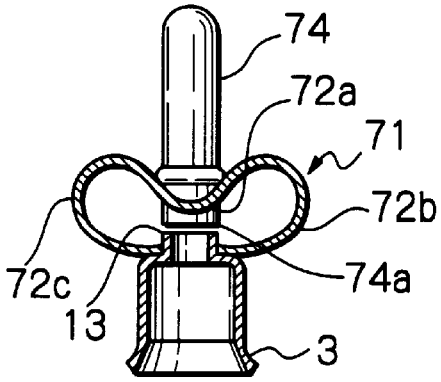
FIG. 7 is a vertical sectional view of the assembly of FIG. 6 along the socket.

FIG. 6 illustrates a fuel delivery rail assembly 70 according to another embodiment of the invention. FIG. 7 shows a vertical section of the assembly 70 of FIG. 6 along the socket. In this embodiment, the section of the a 71 is formed in a reverse eye mask configuration. That is, a central arcuate neck portion 72*a* is connected smoothly and integrally to a right and left arcuate portions 72*b*, 72*c* thereby providing a reverse eye mask configuration. The arcuate portion 72*a* provides a flexible first absorbing surface and the arcuate portions 72*b*, 72*c* provide flexible second absorbing surfaces. The first absorbing surface 72*a* faces the fuel inlet port 13 of the socket 3. To the lateral side of the conduit 71, a fuel inlet pipe 74 is fixed by brazing or welding.

According to the embodiment of FIGS. 6 and 7, when the shock waves flow into the fuel inlet port 13 of the sockets or flow away therefrom by momentary back streams, the pressure pulsations are absorbed at the moment of release into the horizontal enlarged space. In addition, when the thin absorbing surfaces 72*a*, 72*b*, 72*c* are deflected and deformed, the space of contents varies thereby absorbing pressure fluctuations.

As another characteristic of the invention, an inner end 74*a* of the fuel inlet pipe 74 terminates and opens near the center of the longitudinal conduit 71, and the fuel discharge position 74*a* is distant from the center of the socket 3 by a dimension of more than half the width of the conduit 71. This arrangement intends to locate the fuel discharge at a maximum deflecting position of the conduit 71 to thereby enhance the pulsation absorbing performance. However, if the fuel discharge position 74*a* is located too close to the fuel inlet port 13 of the socket 3, the pressure pulsations will be directly transmitted into the socket 3 without being reduced. The vertical and horizontal dimensions of the conduit 71 can be defined such that each wall thickness is 1.2 mm, the height is 13 mm, and the width is 30 mm.

In addition, if the length L from the center of the left socket 3 to the free end of the conduit 71 is larger than 30 mm, the deflections of the conduit 71 relative to the socket 3 caused by the reflecting waves of the injection are smoothly enlarged thereby enhancing the shock absorbing performance.

Figure 8:
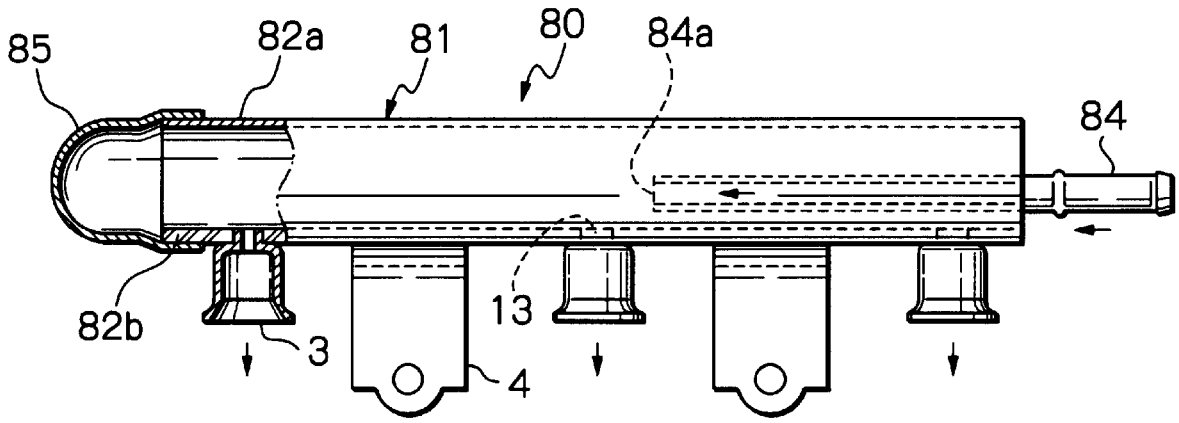
FIG. 8 is a frontal view of the fuel delivery rail assembly according to another embodiment.

FIG. 8 illustrates a fuel delivery rail assembly 80 according to another embodiment of the invention. In this embodiment, the section of a conduit 81 is formed in a rectangular or circular configuration, which includes an upper surface 82*a* of flexible thin plate, and a rigid bottom plate 82*b*. At the longitudinal end of the conduit 81, a flexible cap member 85 is connected smoothly and integrally to the thin plate 82*a*. The thin plate 82*a* provides a flexible first absorbing surface and the cap member 85 provides a flexible second absorbing surface. The first absorbing surface 82*a* faces the fuel inlet port 13 of the socket 3. To the distal end of the conduit 81, a fuel inlet pipe 84 is fixed by brazing or welding, and its inner end 84*a* extends through the conduit 81.

According to the embodiment of FIG. 8, when the shock waves flow into the fuel inlet port 13 of the sockets or flow away therefrom by momentary back streams, the pressure pulsations are absorbed at the moment of release into the horizontal enlarged space. In addition, when the thin absorbing surface 82*a* is deflected and deformed, the space of contents varies thereby absorbing pressure fluctuations.

As another characteristic of the invention, the inner end 84*a* of the fuel inlet pipe 84 terminates and opens near the center of the longitudinal conduit 81, and the fuel discharge position 84*a* is distant from the center of the socket 3 by a dimension of more than half the width of the conduit 81. This arrangement intends to locate the fuel discharge at a maximum deflecting position of the conduit 81 to thereby enhance the pulsation absorbing performance.

The cap member 85 is made from plate materials such as SPCC, SPHC, SUS through plastic working such as restriction working. The radius of curvature of the cap 85 is preferably more than 3 mm, from the view points of elasticity and strength. The vertical and horizontal dimensions of the conduit 81 can be defined such that thin plate thickness is 1.2 mm, the height is 25 mm, and the width is 20 mm.

What is claimed is:

1. In a fuel delivery rail assembly for an internal combustion engine comprising an elongate conduit having a longitudinal fuel passage therein, a fuel inlet pipe fixed to an end or a side of said conduit, and a plurality of sockets vertically fixed to said conduit, adapted to communicate with said fuel passage and so formed as to receive tips of fuel injectors at their open ends, characterized in that:

outer walls of said conduit include at least one flat or arcuate flexible first absorbing surface;

said first absorbing surface is smoothly and integrally connected to at least one arcuate second absorbing surface; and said first absorbing surface or said second absorbing surface faces fuel inlet ports of said sockets;

whereby fuel pressure pulsations and shock waves are reduced by abrupt enlargements of fuel passages and bendings of said absorbing surfaces; and wherein said at least one flexible absorbing surface comprises a flat upper plate, and said at least one arcuate second absorbing surface comprises an arcuate side plate depending from one side of said flat upper plate.

2. A fuel delivery rail assembly as claimed in claim 1, wherein said at least one arcuate second absorbing surface further comprises another arcuate side plate depending from a second side of said flat upper plate.

3. A fuel delivery rail assembly as claimed in claim 2, wherein said outer walls further include a flat bottom plate disposed opposite said flat upper plate and connected with said arcuate side plates.

4. A fuel delivery rail assembly as claimed in claim 3, wherein said first absorbing surface faces said fuel inlet ports of said sockets.

5. A fuel delivery rail assembly as claimed in claim 1, wherein said first absorbing surface faces said fuel inlet ports of said sockets.

* * * * *